US006460534B1

(12) United States Patent
Vasquez et al.

(10) Patent No.: US 6,460,534 B1
(45) Date of Patent: Oct. 8, 2002

(54) MODULAR GUILLOTINE

(75) Inventors: Lucio Vasquez, Lyons; Andrew A. Newcomb, Longmont, both of CO (US)

(73) Assignee: Allcutters Machine and Welding, Lyons, CO (US)

( * ) Notice: Subject to any disclaimer, the term of this patent is extended or adjusted under 35 U.S.C. 154(b) by 0 days.

(21) Appl. No.: 09/593,192

(22) Filed: Jun. 14, 2000

Related U.S. Application Data

(60) Provisional application No. 60/139,361, filed on Jun. 14, 1999.

(51) Int. Cl.[7] ..... B28D 1/32

(52) U.S. Cl. ..... 125/23.01; 125/24; 225/103

(58) Field of Search ..... 125/23.01, 24; 225/103, 104

(56) References Cited

U.S. PATENT DOCUMENTS 2,819,710 A * 1/1958 Mangis ..... 125/23.01
2,867,205 A * 1/1959 Vesper ..... 125/23.01
2,912,970 A * 11/1959 Schlough et al. ..... 125/23.01
3,727,600 A * 4/1973 Schlough ..... 125/23.01
3,809,049 A 5/1974 Fletcher et al.
4,320,924 A 3/1982 Langfield et al.
4,577,613 A 3/1986 Porsfeld et al.
5,134,989 A 8/1992 Akahane
5,152,275 A 10/1992 Landhuis
5,289,816 A 3/1994 Rakowski
5,570,678 A 11/1996 Waggoner et al.
5,638,805 A * 6/1997 Li ..... 125/23.01

* cited by examiner

*Primary Examiner*—Timothy V. Eley
*Assistant Examiner*—Anthony Ojini
(74) *Attorney, Agent, or Firm*—Rick Martin; Patent Law Offices of Rick Martin, PC

(57) ABSTRACT

A known stone cutter having an upper jaw powered for a guillotine type cut has a transverse bar in the upper jaw. A series of cube shaped cutter units are mounted side by side along the transverse bar. An isostatic manifold connects all the cutter units for contouring the cutter jaws to the irregular rock surface. At cut time each cutter unit is hydraulically isolated via a shuttle valve from the isostatic manifold so as not to transmit huge cutting pressures to the isostatic manifold and unused cutter units in that cut.

19 Claims, 6 Drawing Sheets

MODULAR GUILLOTINE

CROSS-REFERENCE TO RELATED APPLICATION

This application is a non-provisional application claiming the benefits of provisional application No. 60/139,361 filed Jun. 14, 1999.

FIELD OF INVENTION

The present invention relates to a stone cutter having a pair of hydraulically activated jaws, wherein a cutting element block of a jaw(s) is made of a plurality of modular cylinder blocks. Each cylinder block houses a hydraulically activated cutting element. After wear each individual cylinder block can be replaced, thus saving replacement of the entire cutting element block.

BACKGROUND OF THE INVENTION

Stonecutters for cutting rough surfaced stone bodies are well known in the art. U.S. Pat. No. 3,809,049 (1974) to Fletcher et al. discloses a guillotine type stone cutter having an upper jaw which has a plurality of individual cutter units welded to a transverse frame base. The frame base can be detached from the upper jaw for maintenance. However, the individual cutter units cannot be replaced without a welding operation. Fletcher does address the problem of cutting a rock having an uneven top surface by claiming his cutter units can extend their cutting elements three to five inches in order to conform to a rock's surface. In operation a common manifold pressures all the pistons in the cutting elements to extremely heavy loads in the 8000 to 10,000 pound range. This hydraulic pressure forces each piston against a surface of the rock at varying heights. Then the manifold input is shut thereby equalizing all the pressure in the manifold, in the supply pipes to each cylindrical cutter element, and in the cylinders of each cutter element. Thus, expensive supply pipes are needed to withstand up to 10,000 pounds of pressure. Then the cut is made by powering the upper jaw to move downward.

Problems. with Fletcher's design include a high cost in labor to replace a worn cutter unit, a high cost in production to cover high pressure hydraulic supply pipes to each cutter unit and an apparent design flaw which would not let a cutting element to fully extend under pressure. It appears that the end cap would explode off at high pressure. Thus, only rocks that were large enough to contact all the cutting elements could be cut.

Other variably extending cutter element systems use an in-line cylinder block design. The cylinder head affixes to the upper jaw. Each cutter element is a piston extending downward in the cylinder head. The common manifold is piped to the individual cylinders. One problem with this old design is the necessity to replace the entire cylinder block at a cost of over $10,000 when a few central cylinders wear out due to the extra wear and tear on the central cutting elements.

The present invention solves several problems in the art including offering a modular cylinder block. Each cutter unit especially the central ones can be disconnected by bolts from the upper jaw and replaced for far less than $10,000. Also each cutter unit is individually valved to disconnect from the manifold once an isostatic state is reached among the cylinders of the cutter elements. Thus, only plastic 250 pound piping is needed to each cutter unit. This saves considerable costs in manufacturing since dozens of cutter units exist on a single machine. Another benefit of the modular bolted on cutter unit design is the ease with which variable width cutting assemblies can be made. Only the transverse mounting bar needs to be custom cut to the width of the stone cutting machine or a subset thereof if desired. Then the proper number of cutter units are bolted on to the transverse bar, and assembly is complete. This is a far less expensive technique than casting a different width cylinder block for each varying width cutter.

SUMMARY OF THE INVENTION

The main aspect of the present invention is to provide a modular set of bolt on cutter units to a transverse mounting bar for a jaw of a guillotine type stone cutter.

Another aspect of the present invention is to provide a shut off valve from the manifold for each cutter unit.

Other. aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
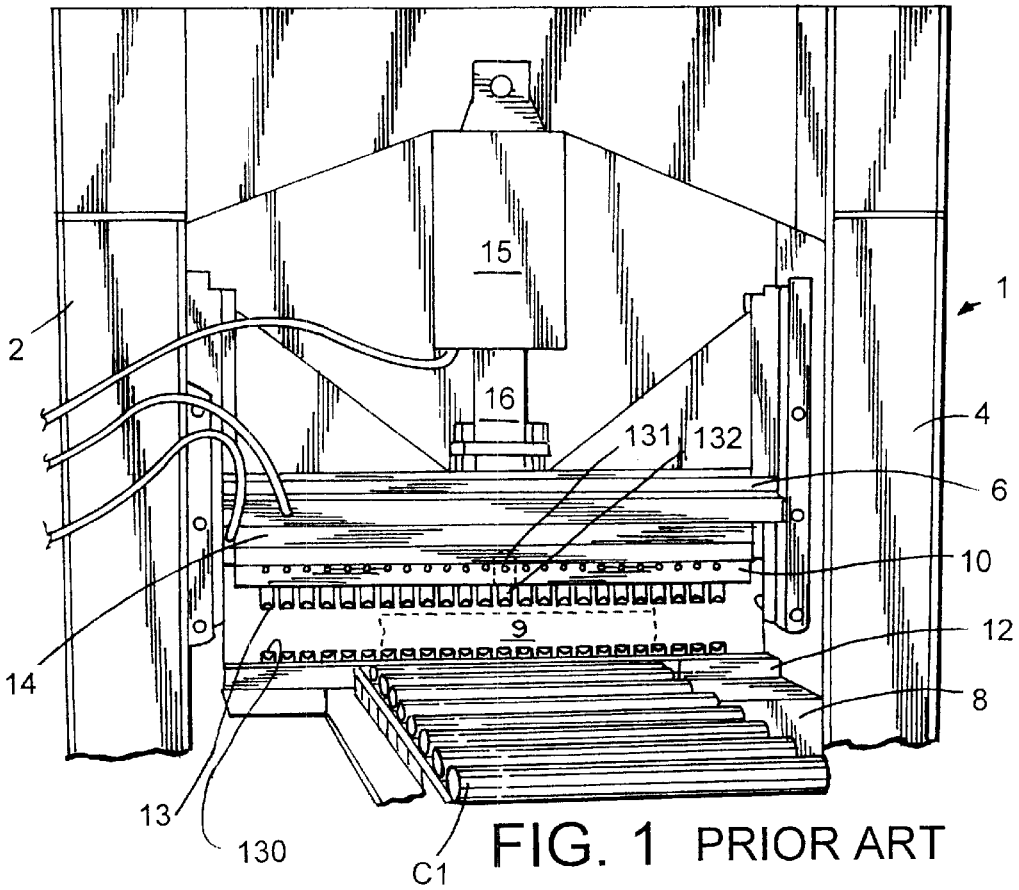
FIG. 1 PRIOR ART
FIG. 1 (prior art) is a front perspective view of a guillotine type stone cutter.

Referring first to FIG. 1 a guillotine type machine 1 is generally called a stone cutter. Spaced vertical sides 2,4 support a hydraulically controlled ram means well known in the art. Located between the vertical sides 2,4 are upper and lower transverse beam members 6,8. One or both of the transverse beam members 6,8 move under hydraulic ramming power to cut a rock 9 stationed between them. Usually both the upper and lower transverse beam members 6,8 have a cylinder block 10,12 respectively, wherein each cylinder block 10,12 supports piston—like upper cutting elements 13 and lower cutting elements 130. A hydraulic. manifold 14 is piped to each of the upper cutting elements 13 so as to allow each cutting element to contour to the peaks and valleys on top of the rock 9 and create an isostatic pressure among the manifold and the individual cylinder block cylinders (not shown) inside the cylinder block 10. Once the isostatic pressure is obtained and the cutting elements 13 are contiguous with the top surface of the rock 9, the hydraulic piston 15 powers the upper transverse bar 6 via piston 16, thereby forcing the cutting elements 13, 130 through the rock. If a central cylinder block cylinder 131 becomes worn, then hydraulic fluid having pressures up to 10,000 pounds will leak out. Such a leak will both discolor the rock and render the cutting element 131 useless. Conveyor rolls Cl are arranged between the vertical sides 2,4 for receiving a rock 9 such as a block of granite and moving the rock a longitudinal path of travel into the desired position for a cut.

Figure 2:
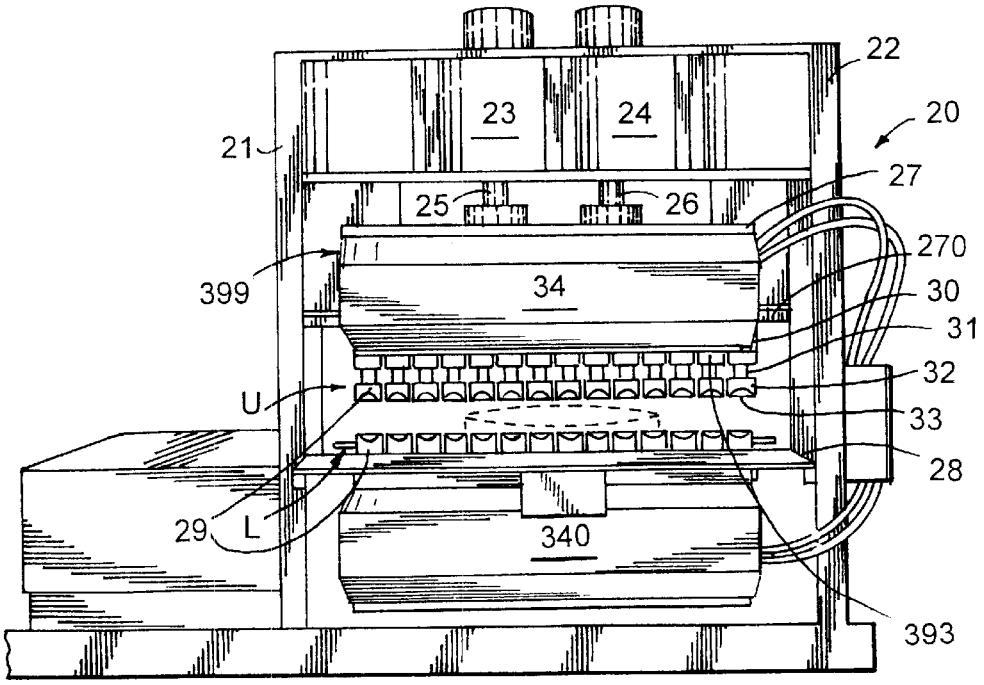
FIG. 2. is a front plan view of the preferred embodiment of the stone cutter having modular cutter units.

Referring next to FIG. 2 the preferred embodiment stone cutter 20 is shown to have spaced vertical sides 21,22 which support hydraulic rams 23,24. The hydraulic rams 23,24 force the upper transverse bar assembly 27 via pistons 25, 26 with tons of force. A lower transverse bar 28 is stationary. Preferably all the cutter units 29 are identical. Each has a master cylinder 30, a piston rod 31, a cutter jaw 32 which has a replaceable tooth 33. The master cylinder is bolted to the upper transverse bar assembly 27 at mounting bar 270.

Hydraulic assemblies 34,340 are piped to each cylinder block 29 to create an upper isostatic pressure for the upper row of cutter units denoted U and a lower isostatic pressure for the lower row of cutter units denoted L. In operation the upper transverse bar assembly 27 is slowly moved down to engage the upper row of cutter units U as well as the lower row of cutter units L with the upper and lower surfaces of the rock 9 respectively. Thus, each set of cutter units U,L conform their cutting jaws 32 with the contours of the rock 9 via isostatic pressure. The nominal range of deviation between the minimum and maximum extension of each piston rod 31 is 1.75 inches. It doesn't matter if some cutter units 29 are not in contact with a rock surface because each master cylinder 30 is isolated from the hydraulic assemblies 34, 340 before the cut is made. Thus, only 250 pounds of force or less is contained in the control lines 310, 311 which do not take part in the cut such as master cylinder 393. A cover 399 shields the hydraulic connections to the master cylinders.

Figure 3:
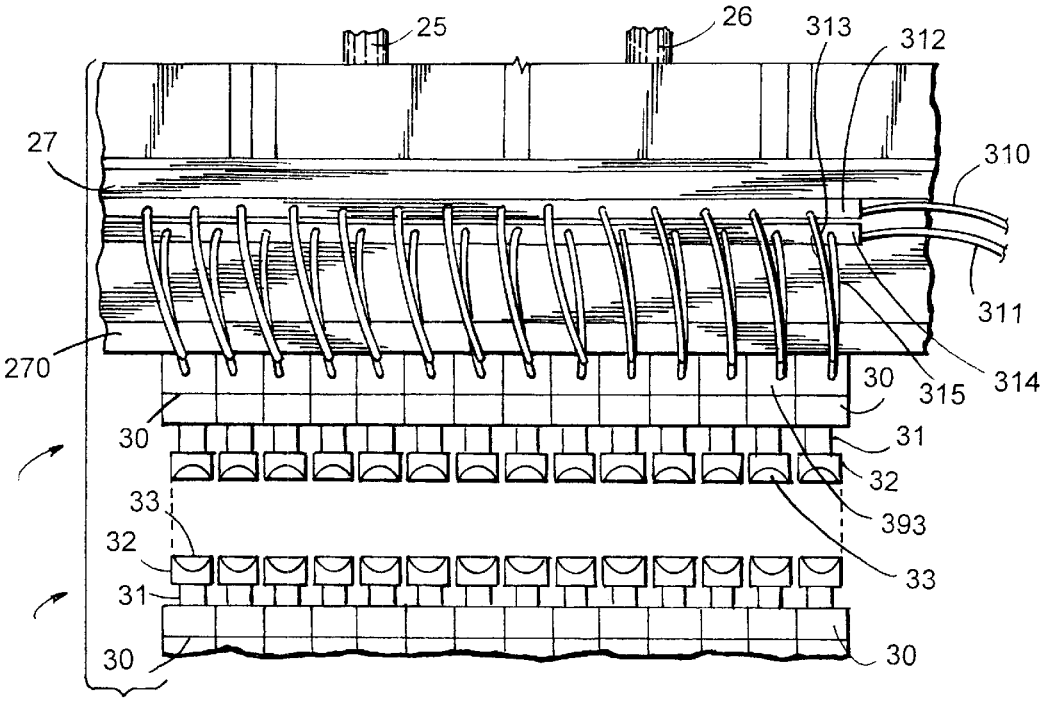
FIG. 3. is a front plan close up view of the modular cutter units of FIG. 2.

Referring next to FIG.3 the hydraulic input line 310 (running under 250 pounds) powers the master cylinders 30 until isostatic pressure is reached among all the master cylinders 30. Then hydraulic control line 311 is charged thereby isolating via shut off shuttle valve 70 shown in FIGS. 7,8 each master cylinder.

Figure 4:
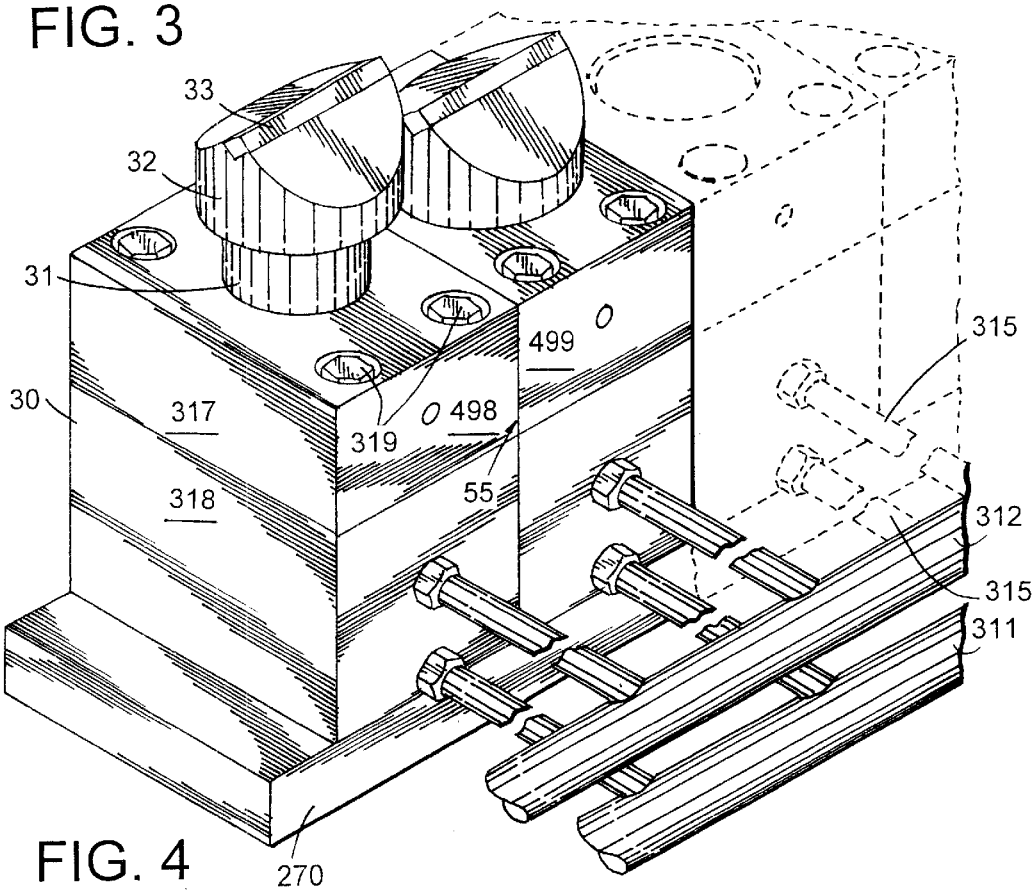
FIG. 4. is a top perspective view of the modular cutter units.

Referring next to FIG. 4 the master cylinder 30 may be made of segments 317,318, wherein bolts 319 secure each master cylinder 30 to the transverse mounting bar 270. The piping 311,312,313,315 can be plastic with a 250 pound rating (rather than a tonnage rating) because the isostatic pressure for positioning each cutter tooth 32 is isolated from the tonnage pressure created by the cut in the master cylinder/cutter jaws in contact with the rock.

Figure 5:
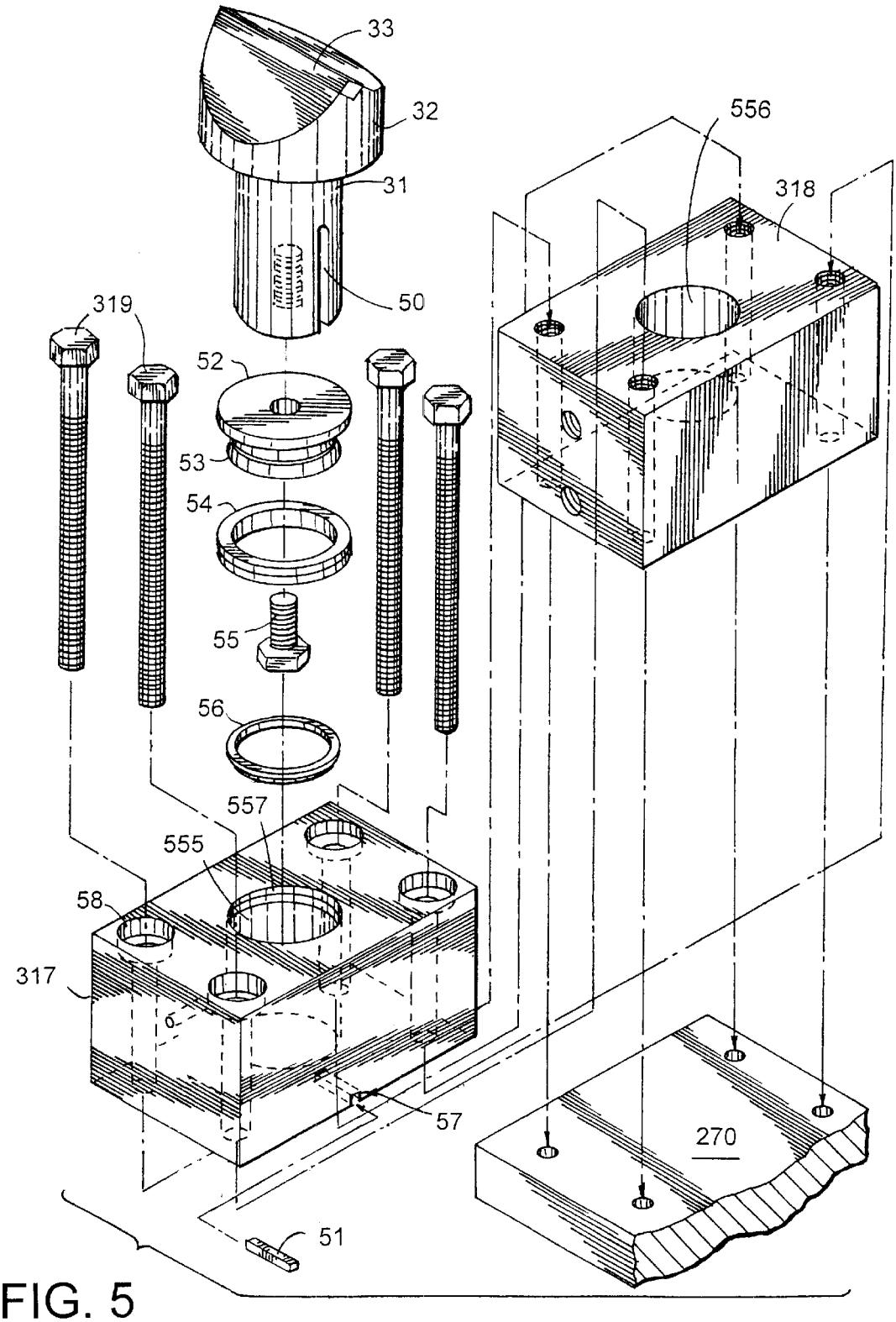
FIG. 5. is an exploded view of the modular cutter units.

Referring next to FIG. 5 the piston 31 has a groove 50 to keep it aligned. A key 51 goes in slot 57 and into the groove 50. Each neighboring master cylinder segment acts as a lock to keep the key 51 in place (see FIG. 4 wherein segment 499 locks the key of segment. 498 in place with segment 499's side surface 55).

Holes 58 receive bolts 319. A bolt 55 secures a piston base 52 to the piston rod 31. Piston base 52 has a groove 53 which secures the seal 54 thereto.

Segment 317 has a hole 555 which aligns hole 556 in segment 318. Hole 555 has a groove 557 which secures the dirt seal 56.

Figure 7:
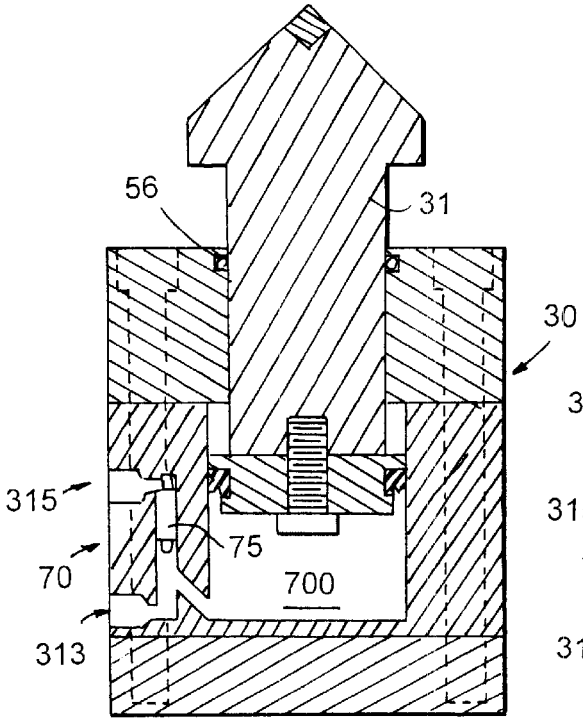
FIG. 7. is a sectional view of the modular cutter unit taken along line 7,8 of FIG. 6 with the cutting element extended.
Figure 8:
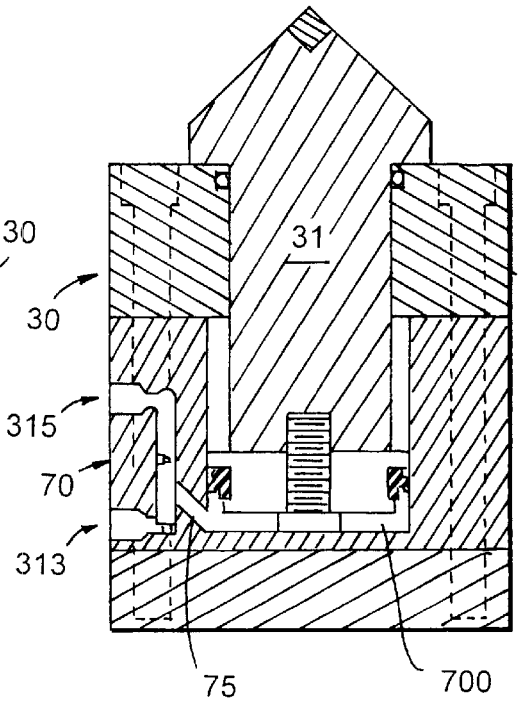
FIG. 8. is the same view as FIG. 7 with the cutting element withdrawn.

Referring next to FIG. 7 the shuttle valve 70 comprises an inlet port 313 which isostatically pressurizes the cylinder chamber 700. When the cut is to be made the shuttle valve 70 isolates each master cylinder 30 by pressurizing control port 315, thereby forcing valve pin 75 across inlet port 313 as shown in FIG. 8. The hydraulic pressure to inlet port 313 is temporarily cut off.

Figure 9:
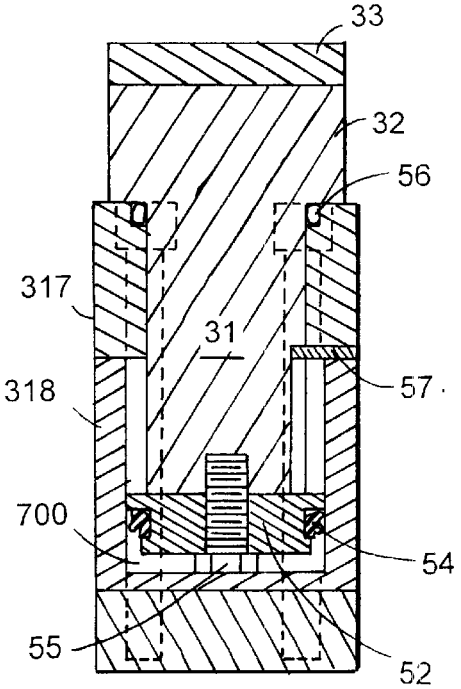
FIG. 9. is a sectional view of the modular cutter unit taken along line 9—9 of FIG. 6.
Figure 6:
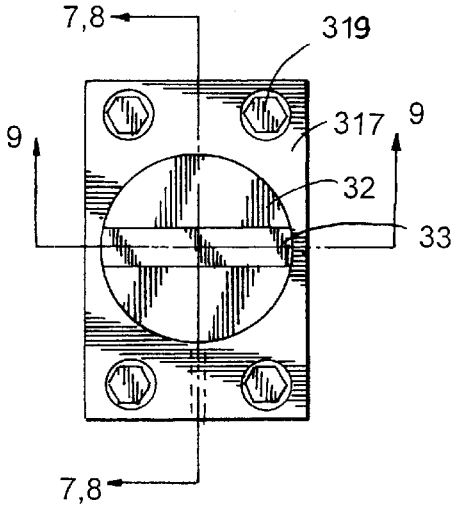
FIG. 6. is a top plan view of a modular cutter unit.

Referring next to FIG. 9 members 31, 32 are machined from one piece of metal.

Figure 10:
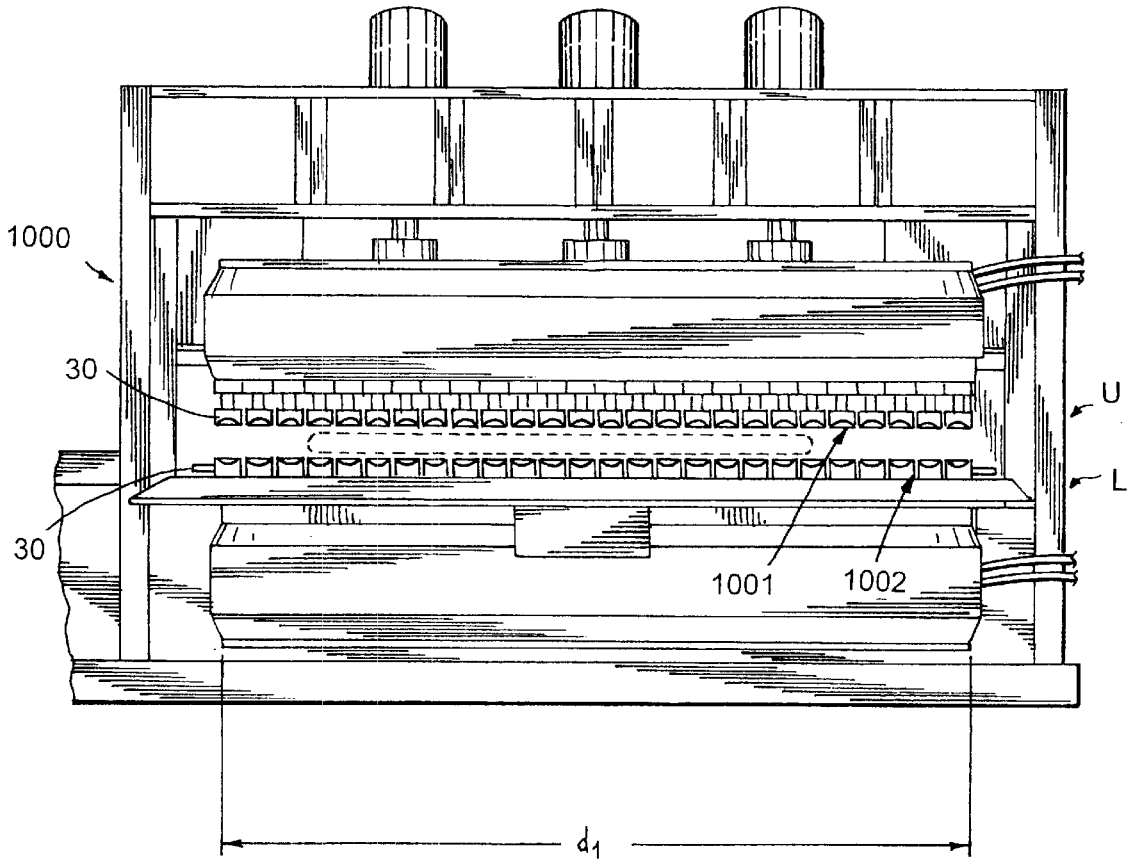
FIG. 10. is a front plan view of a wide body embodiment of the present invention.

Referring next to FIG. 10 a wide body stone cutter 1000 has a jaw width $d_1$. The upper U and Lower L cutter unit assemblies 1001,1002 respectively are cost effectively manufactured by bolting the necessary number of cylinder blocks 30 onto their custom length $d_1$ transverse bars (not shown but analogous to 270,28).

Figure 11:
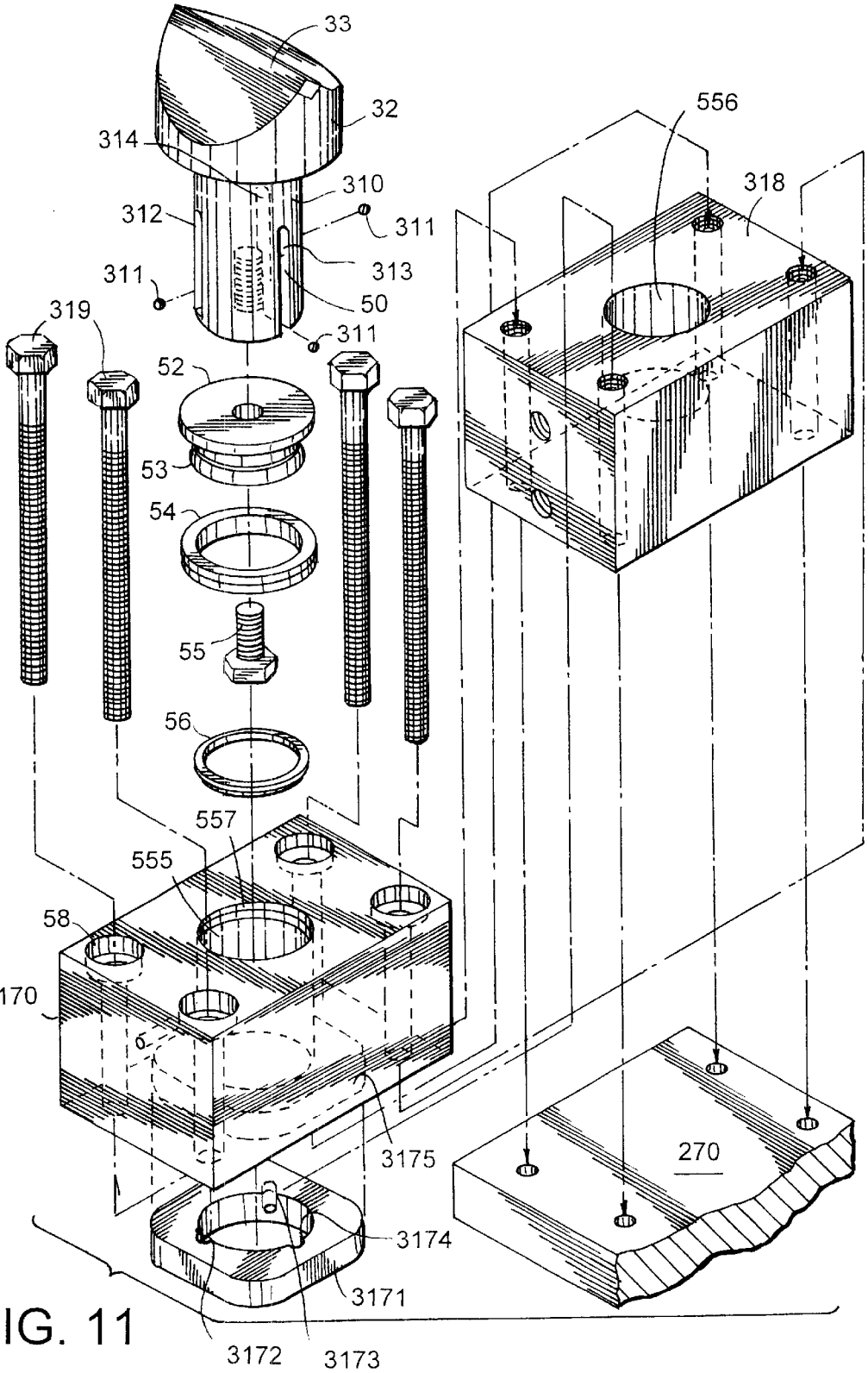
FIG. 11. is an exploded view of the preferred embodiment master cylinder assembly.

Referring next to FIG. 11 the preferred embodiment structure for stabilizing the piston rod 31 of FIG. 5 is shown, wherein piston rod 310 now has three vertical grooves 312,313,314. Three alignment balls 311 ride in grooves 312,313,314, and are held in place by their respective receiving grooves 3172,3174,3173, in the collar 3171 which fits into a recess 3175 of the master cylinder segment 3170.

Although the present invention has been described with reference to preferred embodiments, numerous modifications and variations can be made and still the result will come within the scope of the invention. No limitation with respect to the specific embodiments disclosed herein is intended or should be inferred.

We claim:

1. A cutting jaw for a guillotine stone cutter, said cutting jaw comprising:

an upper transverse bar;

a plurality of master cylinder blocks connected serially onto the transverse bar; and said master cylinder blocks each having an isolation valve to isolate a master cylinder in each master cylinder block from a cutting pressure.

2. A cutting jaw comprising:

a transverse bar;

a plurality of master cylinders affixed to said transverse bar;

wherein each master cylinder has a movable piston having a cutting height adjustment range;

a low pressure manifold and a connecting line to each master cylinder, thereby providing a pressure to move each movable piston to a cutting height; and wherein each master cylinder has an isolation valve associated therewith, thereby enabling the low pressure manifold and connecting lines to set the cutting height (s) of the movable pistons as they contact a workpiece, and further enabling an isolation of the low pressure manifold and connecting lines from a high pressure cutting pressure.

3. The apparatus of claim 2, wherein the master cylinder each further comprise a block removably secured to the transverse bar.

4. The apparatus of claim 3, wherein the isolation valve further comprises a pressure activated valve pin movable across an inlet port of the block.

5. The apparatus of claim 3, wherein the block further comprises a first segment and a second segment, said first segment having a grooved collar and an alignment ball to align the movable piston, wherein the movable piston has a respective alignment groove for receiving the alignment ball.

6. The apparatus of claim 3, wherein a cutting width is formed by securing a desired number of blocks to the transverse bar.

7. The apparatus of claim 3, wherein each movable piston has a replaceable cutting tooth.

8. The apparatus of claim 3 further comprising a stone cutter frame having a high pressure manifold powering the transverse bar.

9. The apparatus of claim 8, wherein the frame further comprises a lower transverse bar having master cylinders each with a movable piston, an associated isolation valve, and a connection to a low pressure manifold.

10. The apparatus of claim 3, wherein the block removably secured to the transverse bar further comprises a bolt threaded into the transverse bar.

11. The apparatus of claim 3, wherein the movable piston has a range of adjustment from zero to three inches.

12. A method to cut a stone comprising the steps of:

lowering a transverse bar having a plurality of master cylinders each with a movable piston in contact with the stone;

allowing a low pressure manifold to equalize a pressure among the master cylinders as each piston extends into contact with the stone or reaches a maximum extension position;

isolating each of the master cylinders from the low pressure manifold; and activating a high pressure device to force the movable pistons to cut the stone.

13. The method of claim 12, wherein the step of activating a high pressure device further comprises activating a manifold to lower the transverse bar.

14. A cutting jaw comprising:

a transverse bar;

a plurality of master cylinder blocks each removably fastened to the transverse bar;

wherein each block has a movable piston; and wherein each block has a connection to a low pressure source and has an associated isolation valve to that source.

15. The apparatus of claim 14 further comprising a stone cutting frame having a high pressure source to enable the transverse bar to cut a stone after the isolation valves are set to isolate the low pressure source from each block.

16. The apparatus of claim 15, wherein the isolation valves each further comprise a sliding pin powered by a low power force, said sliding pin closable over a low pressure inlet in the block.

17. The apparatus of claim 14, wherein each master cylinder block further comprises a fastener bolt to the transverse bar.

18. A cutting jaw comprising:

a transverse bar, a plurality of master cylinder blocks each removably fastened to the transverse bar;

wherein each block has a movable piston;

wherein each master cylinder block further comprises a fastener bolt to the transverse bar; and wherein each master cylinder block further comprises a first and a second segment, said first segment having an alignment mechanism for the piston.

19. The apparatus of claim 18, wherein the alignment mechanism further comprises a groove in the movable piston, a matching groove in the first segment and an alignment ball riding in said grooves.

* * * * *